US007556662B2

(12) United States Patent
Lee et al.

(10) Patent No.: US 7,556,662 B2
(45) Date of Patent: Jul. 7, 2009

(54) MULTI-CYCLONE DUST SEPARATING APPARATUS

(75) Inventors: Dong-yun Lee, Gwangju (KR); Oh-gyu Gweun, Goyang-si (KR); Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 478 days.

(21) Appl. No.: 11/315,335

(22) Filed: Dec. 23, 2005

(65) Prior Publication Data

US 2006/0168923 A1 Aug. 3, 2006

(30) Foreign Application Priority Data

Jan. 31, 2005 (KR) ..... 10-2005-0008585
Apr. 4, 2005 (KR) ..... 10-2005-0027927

(51) Int. Cl.
*B01D 45/12* (2006.01)

(52) U.S. Cl. ..... 55/345; 55/349; 55/429; 55/337; 55/DIG. 3; 95/268; 15/353

(58) Field of Classification Search ..... 55/345, 55/343, 349, 429, DIG. 3, 337, 268; 15/353; 95/268

See application file for complete search history.

(56) References Cited

U.S. PATENT DOCUMENTS 7,261,754 B2 * 8/2007 Oh et al. ..... 55/343
7,341,611 B2 * 3/2008 Greene et al. ..... 55/337
2004/0010885 A1 * 1/2004 Hitzelberger et al. ..... 15/352
2004/0025285 A1 2/2004 McCormick et al.
2005/0252180 A1 * 11/2005 Oh et al. ..... 55/345

FOREIGN PATENT DOCUMENTS

| | | |
|---|---|---|
| CN | 22550815 Y | 2/1997 |
| DE | 10 2004 030600 | 9/2005 |
| KR | 10-2004-0099980 | 12/2004 |
| WO | WO-99/42198 | 8/1999 |
| WO | WO-00/74548 | 12/2000 |

OTHER PUBLICATIONS

Chinese Patent Office, Office Action issued Jan. 19, 2007 in corresponding Chinese Application No. 2006100047624.4 (with English Translation).

* cited by examiner

*Primary Examiner*—Duane Smith
*Assistant Examiner*—Dung Bui
(74) *Attorney, Agent, or Firm*—Blank Rome LLP

(57) ABSTRACT

A multi-cyclone dust separating apparatus includes: a multi-cyclone unit including a first cyclone chamber body having a first cyclone chamber and at least one protection chamber formed around at least a portion of an outer circumference of the first cyclone chamber, and at least one secondary cyclone chamber body disposed in the protection chamber, each secondary cyclone chamber body having at least one secondary cyclone chamber; a cover unit connecting an upper end of the multi-cyclone unit and guiding air discharged from the first cyclone chamber to the at least one secondary cyclone chamber; a dirt collecting unit adapted to connect to a lower end of the multi-cyclone unit and configured to collect dirt separated from the air in the first and secondary cyclone chambers; and an air discharge duct configured to discharge air that has passed through the multi-cyclone unit.

15 Claims, 4 Drawing Sheets

MULTI-CYCLONE DUST SEPARATING APPARATUS

CROSS-REFERENCE TO RELATED APPLICATIONS

This application claims the benefit of priority under 35 U.S.C. § 119 to Korean Patent Application No. 2005-08585, filed on Jan. 31, 2005 and Korean Patent Application No. 2005-27927, filed on Apr. 4, 2005, the contents of each of which are incorporated herein by reference. This application may also be related to commonly owned U.S. patent application Ser. No. 10/840,248, filed May 7, 2004; commonly owned U.S. patent application Ser. No. 10/840,230, filed May 7, 2004; commonly owned U.S. patent application Ser. No. 10/840,231, filed May 7, 2004; commonly owned U.S. patent application Ser. No. 10/840,229, filed May 7, 2004; commonly owned U.S. patent application Ser. No. 10/832,346, filed Apr. 27, 2004; commonly owned U.S. patent application Ser. No. 10/851,114, filed May 24, 2004; commonly owned U.S. patent application Ser. No. 10/847,593, filed May 18, 2004; commonly owned U.S. patent application Ser. No. 10/847,257, filed Jun. 24, 2004; commonly owned U.S. patent application Ser. No. 10/857,892, filed Jun. 2, 2004; and commonly owned U.S. patent application Ser. No. 11/149,201, filed Jun. 10, 2005, the contents of each of which are herein incorporated by reference.

FIELD OF THE INVENTION

The present invention relates to a multi-cyclone dust separating apparatus.

BACKGROUND OF THE INVENTION

A cyclone dust separating apparatus separates dust from dust laden air using centrifugal force. Cleaned air is discharged while the dust separated is collected in a dust collecting chamber. Cyclone dust separating devices are used in vacuum cleaners because they can be used permanently (unlike a dust bag, which requires replacement when it becomes full).

One problem with cyclone dust separators is their relative inability to separate out fine dust particles. To overcome this limitation, so-called multi-cyclone dust separating devices have been suggested in order to improve dust separation efficiency. The multi-cyclone dust separating apparatus includes a first cyclone chamber and a plurality of secondary cyclone chambers which are arranged in series or parallel. Relatively large dust particles are separated out in the first or primary cyclone; smaller dust particles are separated out in the second or secondary cyclones.

Although multi-cyclone dust separating devices provide better dirt particle separation than conventional cyclone dust separating devices, their ability to separate out minute dirt particles is compromised by the geometry required to route dust laden air through a primary cyclone and then into one or more secondary cyclones.

The suction force in a multi-cyclone dust separator is typically obtained from a suction force source applied to the multi-cyclone separator at a lower portion of the multi-cyclone dust separating apparatus. The vacuum source must draw dust laden air through a multi-cyclone dust separating apparatus after it has drawn the dust laden air through one or more secondary cyclones, which receive air from a primary cyclone. Extending a vacuum through a multi-cyclone dust separating apparatus from the dirt laden air intake to the filtered air outlet usually requires at least one extra duct to connect the cyclones of different stages to each other. Among other things, extra ducting makes the structure of the multi-cyclone dust separating apparatus big and complicated. In addition, additional ducting reduces suction force because of head losses attributable to an increased air path length.

Another problem resulting from prior multi-cyclone dust separating devices is the single dirt collecting unit, into which the various cyclones dump the centrifuged dirt and dust particles. A user cannot empty individual dirt collecting chambers. Rather, the user is required to empty the entire chamber. Since the dust-collecting chambers are not separable from each other, it is sometimes inconvenient to clean or repair a single dust-collecting chamber.

SUMMARY OF THE INVENTION

The present invention has been developed in order to solve at least the above-identified shortcomings and problems in the related art.

To this end, a first non-limiting aspect of the present invention provides a multi-cyclone dust separating apparatus, which includes: a multi-cyclone unit including a first cyclone chamber body having a first cyclone chamber and at least one protection chamber formed around at least a portion of an outer circumference of the first cyclone chamber and at least one secondary cyclone chamber body disposed in the at least one protection chamber, each secondary cyclone chamber body having at least one secondary cyclone chamber; a cover unit adapted to connect to an upper end of the multi-cyclone unit and configured to guide air discharged from the first cyclone chamber to the at least one secondary cyclone chamber; a dirt collecting unit adapted to connect to a lower end of the multi-cyclone unit and configured to collect dirt separated from the air in the first and the secondary cyclone chambers; and an air discharge duct disposed proximate to a center of the cover unit and the dirt collecting unit and configured to downwardly discharge air that has passed through the at least one secondary cyclone chamber through the multi-cyclone unit and the dirt collecting unit.

A second non-limiting aspect of the present invention provides a multi-cyclone dust separating apparatus including: a first cyclone chamber having a wall with a circumference; secondary cyclone chambers positioned around the circumference of the first cyclone chamber; an air stagnating chamber for connecting the first cyclone chamber and the secondary cyclone chambers; and a filter mounting chamber connected to the air stagnating chamber, for mounting a filter therein, wherein dirt is separated from the air by passing through the first and the secondary cyclone chambers, the air stagnating chamber, and the filter.

Yet another non-limiting aspect of the present invention provides a multi-cyclone dust separating apparatus, which includes: a multi-cyclone unit including at least one first cyclone chamber having at least one protection chamber formed around at least a portion of a circumference thereof, and at least one second cyclone chamber arranged in the at least one protection chamber; means for guiding air discharged from the at least one first cyclone chamber to the at least one second cyclone chamber; means for collecting debris separated from the air in at least one of the first and second cyclone chambers; and means for discharging the air after the air has passed through the at least one second cyclone chamber.

BRIEF DESCRIPTION OF THE DRAWINGS

The above aspects and other advantages of the present invention will be more apparent by describing an embodiment of the present invention with reference to the accompanying drawings, in which.

In the drawings, it should be understood that like reference numerals refer to like features and configurations.

DETAILED DESCRIPTION OF THE EMBODIMENTS

Hereinafter, a multi-cyclone dust separating apparatus according to a non-limiting embodiment of the present invention will now be described in greater detail with reference to the accompanying drawings.

Figure 1:
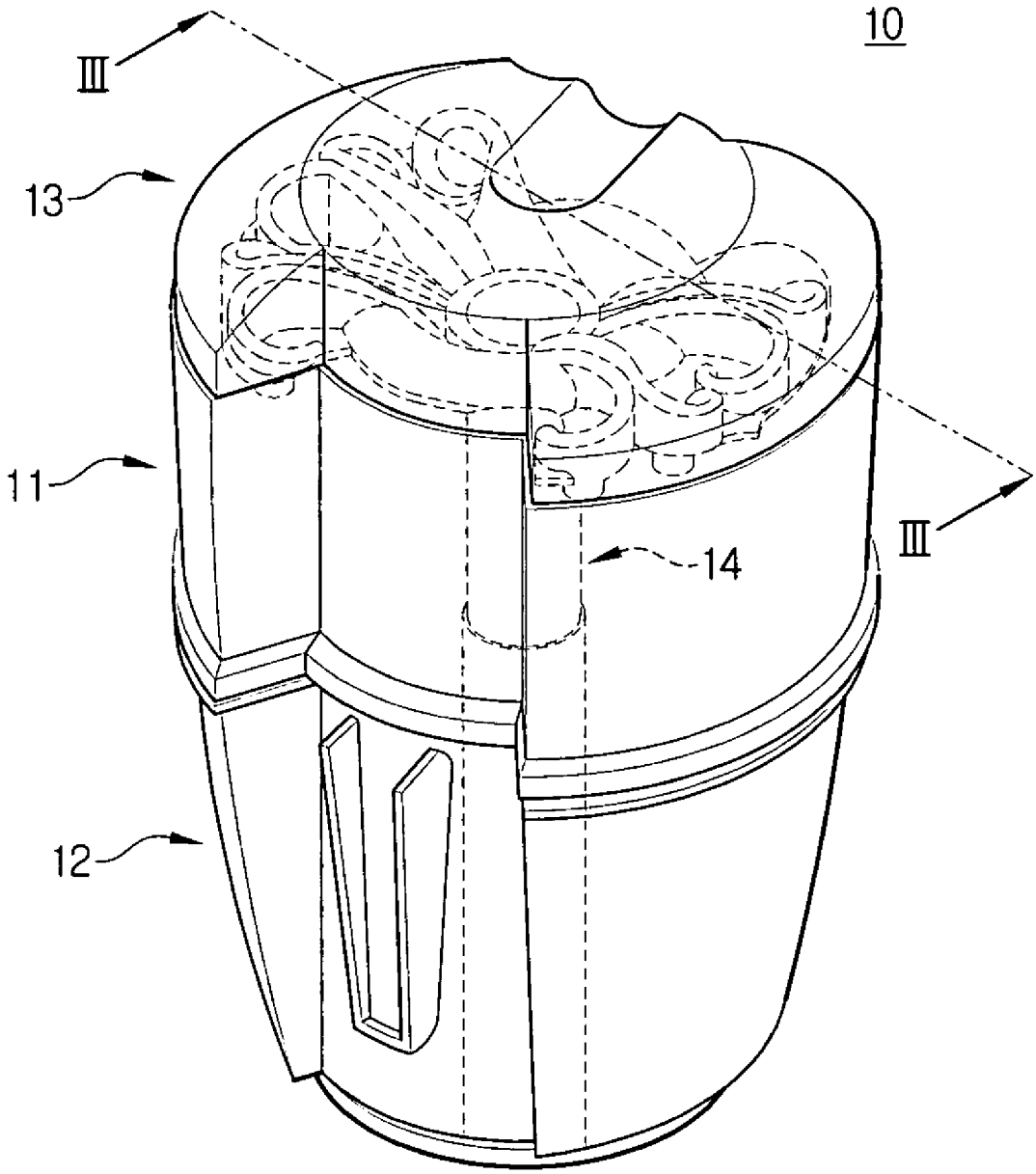
FIG. 1 is a perspective view of a multi-cyclone dust separating apparatus according to a non-limiting embodiment of the present invention.
Figure 2:
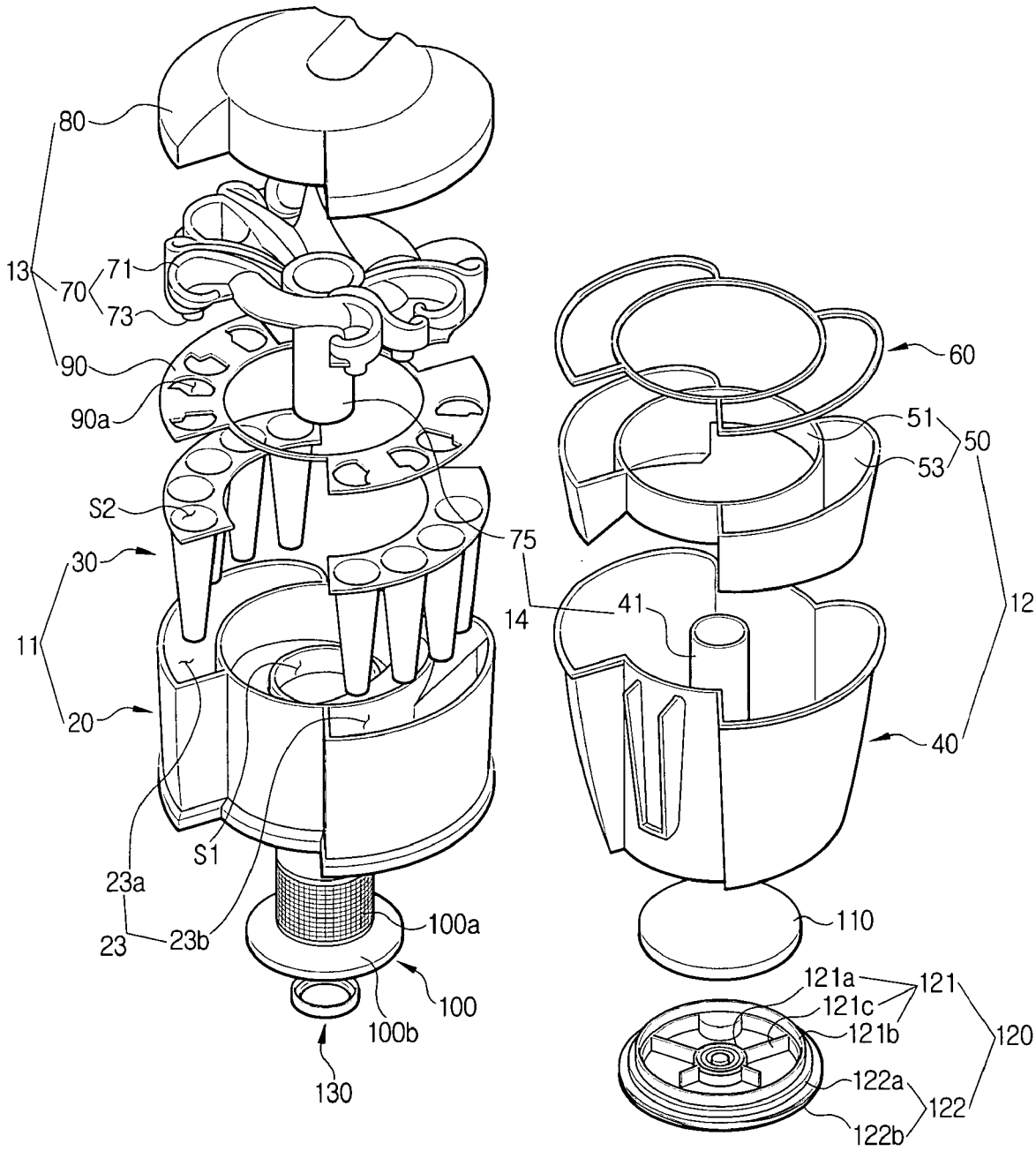
FIG. 2 is an exploded perspective view of the multi-cyclone dust separating apparatus of FIG. 1.

Referring to FIG. 1, a multi-cyclone dust separating apparatus 10 includes a multi-cyclone unit 11, a dirt (and/or debris) collecting unit 12, a cover unit 13 and an air discharge duct 14. In FIG. 2, the multi-cyclone unit 11 includes a first cyclone chamber body 20 and a plurality of secondary cyclone chamber bodies 30 to centrifugally separate dirt from drawn-in air. The first cyclone chamber body 20 includes a first cyclone chamber S1 formed in a center portion thereof and a protection chamber 23 formed along a circumference of the wall of the first cyclone chamber S1 in a non-connecting manner such that the secondary cyclone chamber bodies 30 are separate structures.

The first cyclone chamber S1 has an air suction port 21*a* (see FIG. 3) formed on a side of the first cyclone chamber S1 to allow the dust laden air to be drawn therethrough. The dust laden air experiences a centrifugal force as it passes through the first cyclone chamber S1 and out the air suction port 21*a* (see FIG. 3). Dirt is separated from air that passes through the first cyclone chamber S1 by the centrifugal force.

The protection chambers 23 have annulus or pocket-shaped spaces 23*a* and 23*b* formed along the circumference of the wall of the first cyclone chamber S1. The pocket-shaped spaces 23*a* and 23*b* are separated from each other such that they subtend an angle less than 180 degrees around the center of the first cyclone chamber S1. The pocket-shaped spaces 23*a* and 23*b* are evenly spaced around the center of the first cyclone chamber S1 and spaced apart from each other although alternate embodiments may include asymmetrically sized pocket spaces as well as asymmetrically placed pocket spaces.

As referred to herein, the protection chamber pockets 23*a* and 23*b* are also identified as a first protection chamber 23*a* and a second protection chamber 23*b*, respectively. As shown in the figures, they may be symmetrical to each other with respect to the first cyclone chamber S1. Several of the secondary cyclone chamber bodies 30, which can be preferably formed as a single structure, can be inserted into the first and the second protection chambers 23*a* and 23*b*.

Each secondary cyclone chamber body 30 has at least one cone or frustum-shaped secondary cyclone chamber S2 formed therein, each of which is shaped to create within them a cyclone or vortex by which air particles passing therethrough experience a centrifugal force and are separated out of suspension. When the drawn-in air descends and ascends in the secondary cyclone chambers S2 (see FIG. 3), airborne dirt is separated from the air by the centrifugal force exerted on the dirt particles by the vortex in each secondary cyclone chamber body 30.

Each of the plurality of secondary cyclone chamber bodies 30 that each include secondary cyclone chambers S2 can be inserted as an assembly into the first and second protection chambers 23*a* and 23*b* as a unit because the secondary cyclone chamber bodies 30 may be assembled, connected, molded, or otherwise can be formed as an integral unit. In the preferred embodiment, five of the secondary cyclone chambers S2 are assembled, connected, or molded with one another and inserted in the first protection chamber 23*a*. Four of the secondary cyclone chambers S2 are inserted in the secondary protection chamber 23*b*. Alternate embodiments may include more than five or less than four secondary cyclone chambers S2, depending on the size of each of the cone or frustum-shaped cyclone chambers S2 as well the diameter of the first cyclone chamber S1 and the width of the protection chambers 23*a* and 23*b*. At least one alternate embodiment provides frustum-shaped cyclone chambers S2 of different sizes in the different protection chambers to provide different sized vortexes to centrifugally filter differently sized particles.

Figure 3:
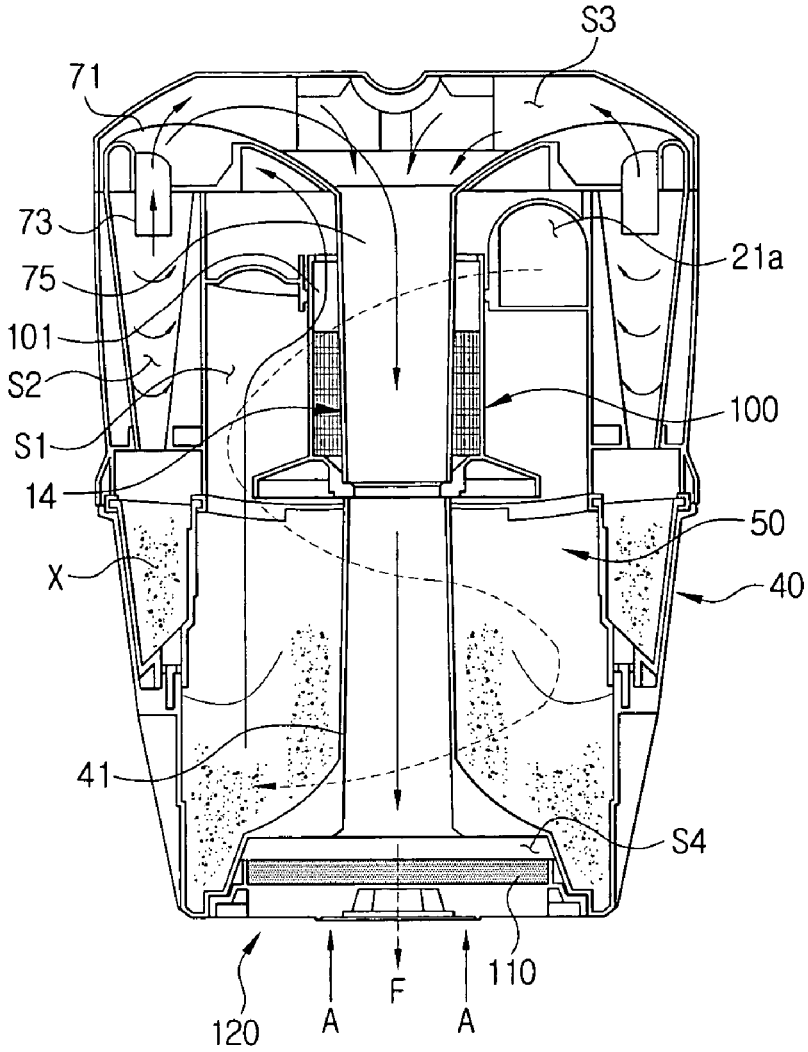
FIG. 3 is an elevational view of the multi-cyclone dust separating apparatus in section taken along line III-III of FIG. 1.

As can be seen in FIG. 2 and FIG. 3, the dirt collecting unit 12 is connected with a lower end of the multi-cyclone unit 11 to store dirt separated out in both the first cyclone chamber S1 and the secondary cyclone chambers S2. The dirt collecting unit 12 includes a main dust receptacle 40 that stores dust from the first cyclone chamber S1 and a sub-dust receptacle 50, which stores dirt from the secondary cyclone chambers S2.

The main dust receptacle 40 is connected with a lower end of the first cyclone chamber body 20 to store the dirt separated in the first cyclone chamber S1. A gasket or sealing member 60 can be inserted between the main dust receptacle 40 and the first cyclone chamber body 20 as shown, such that the main dust receptacle 40 and the first cyclone chamber body 20 are closely and tightly connected with each other. The sealing member 60 can be inserted in a recess (not shown) formed along an inside edge of the main dust receptacle 40.

A filter mounting chamber S4 is formed on a lower portion of the main dust receptacle 40. An upper portion of the filter mounting chamber S4 is connected with a lower duct 41, and a filter 110 is inserted in the filter mounting chamber S4. A lower portion of the filter mounting chamber S4 is connected with a filter mounting cover 120 which fixes the filter 110 in the filter mounting chamber S4 by pressing the filter 110 in a direction of an arrow A. The filter mounting cover 120 may include a first circular portion 121 and a second circular portion 122.

The first circular portion 121 includes a circular core 121*a* in a center thereof, a circular sidewall 121*b* along a circumference of the first circular portion 121, and four connecting members 121*c* connecting the circular core 121*a* and the circular sidewall 121*b*. The filter 110 is inserted into the first circular portion 121, such that the filter 110 is enclosed by the circular sidewall 121*b* and supported by the circular core 121*a* and the connecting members 121*c*.

The second circular portion 122 is formed in a stepwise structure including a first step portion 122*a* and a second step portion 122*b*. The first step portion 122*a* supports the first circular portion 121 and is longer than the first circular portion 121 in diameter. The second step portion 122*b* supports the first step portion 122*a* and is longer than the first step portion 122*a* in diameter. Although the filter mounting cover 120 may include only the first circular portion 121 without the second circular portion 122, the filter mounting cover 120 may preferably include the first circular portion 121 and the second circular portion 122 for a user to conveniently grip.

As can be seen in FIG. 3, according to the above-explained configuration, the filter 110 is inserted into the first circular portion 121 and then the filter mounting cover 120 is connected with the filter mounting chamber S4 by press fitting in the direction of arrow A. Accordingly, as the air is passed through the lower duct 41 and the filter 110 as an arrow F in FIG. 3, drawn toward the vacuum source (not shown), dust is separated and collected by the filter 110 inserted into the filter mounting chamber S4. Accordingly, inflow of fine dust into the vacuum source (not shown) is prevented.

In the meantime, as shown in FIG. 3, the filter mounting cover 120 may be also connected with the filter mounting chamber S4 by rotating, instead of press fitting.

Figure 4A:
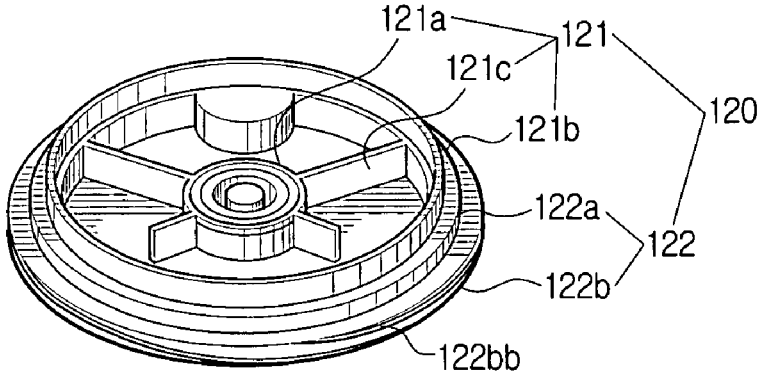
FIG. 4A is a perspective view of a non-limiting example of a filter mounting cover with a male screw.
Figure 4B:
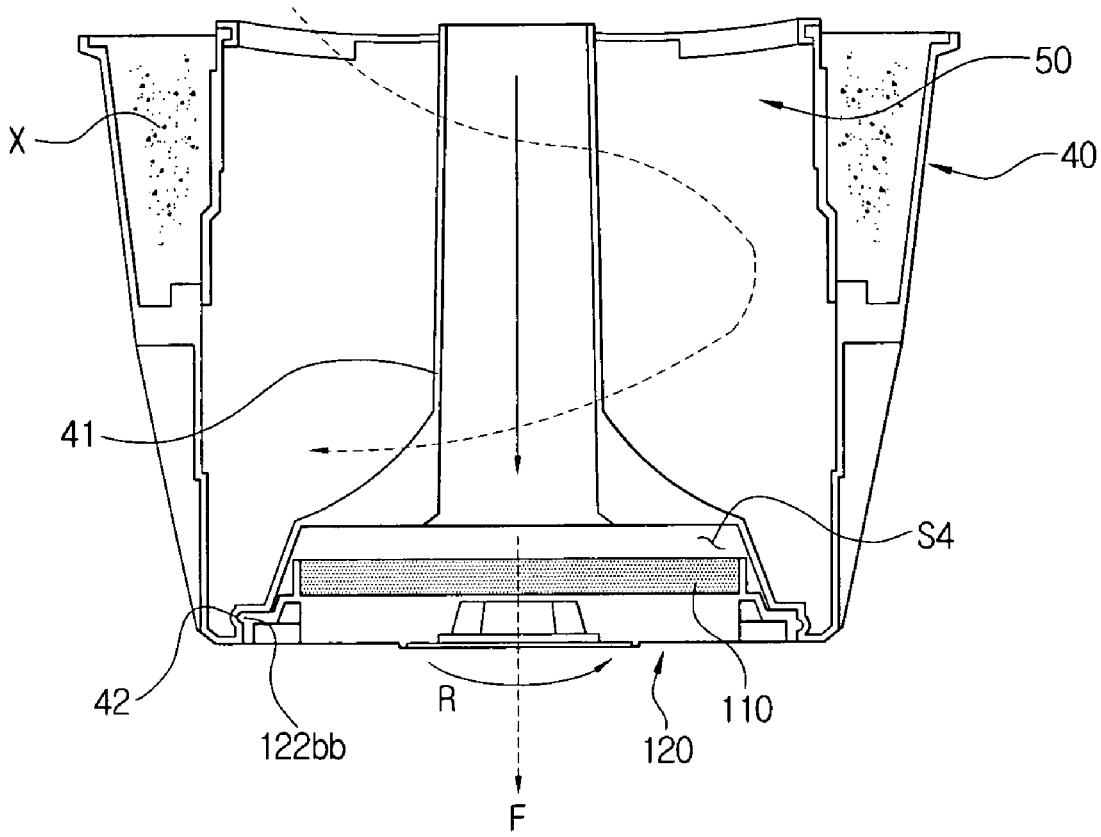
FIG. 4B is an enlarged elevational view of a main dust receptacle in section, showing a female screw being fit with the filter mounting cover of FIG. 4A.

Referring to FIG. 4A and FIG. 4B, a female screw 42 may be formed along an internal circumference of the filter mounting chamber S4, and a male screw 122*bb* corresponding to the female screw 42 may be formed along an external circumference of the second circular portion 122 of the filter mounting cover 120. More particularly, in this embodiment, the male screw 122*bb* is formed along the second step portion 122*b* of the second circular portion 122. Of course, the female screw 42 for the second circular portion 122 and the male screw 122*bb* for the filter mounting chamber S4 may be formed.

Referring to FIG. 4B, according to the above-described configuration, the filter mounting cover 120 may be rotated in a direction of an arrow R and connected with the filter mounting chamber S4. At this time, the male screw 122*bb* of the second circular portion 122 and the female screw 42 of the filter mounting chamber S4 are coupled with each other, such that the filter mounting cover 120 becomes connected with the filter mounting chamber S4.

If the filter mounting cover 120 is connected with the filter mounting chamber S4 by rotating, the filter 110 may be easily connected to or disconnected from the filter mounting chamber S4. Accordingly, it is easy to clean and repair the filter 110.

A sub-dust receptacle 50 can be removably inserted in the main dust receptacle 40 to collect dirt particles that are separated out by the secondary cyclone chamber bodies 30. In such an embodiment, a user can empty the main dust receptacle 40 or empty the sub-dust receptacle 50 selectively according to amounts of dirt collected in the respective main and sub-dust receptacles 40 and 50 on an as-needed basis. Since the main dust receptacle 40 and the sub-dust receptacle 50 are detachable from each other, they can be separately emptied when necessary.

As can be seen in FIG. 2, the exterior contour of the sub-dust receptacle 50 may conform to the inside of the main dust receptacle 40 and may include an inner cylinder part 51 and a pocket part 53 around the inner cylinder part 51. The cylinder part 51 is formed in a center of the sub-dust receptacle 50 and has an open bottom, which allows the dirt separated in the first cyclone chamber S1 to drop down to the main dust receptacle 40. The pocket part 53 is formed to extend partway around the cylinder part 51 and to correspond to the protection chamber 23 to collect dirt separated in the secondary cyclone chambers S2. The pocket part 53 has a closed bottom so that dirt is collected therein.

The cover unit 13 shown in FIG. 1 and in an exploded view in FIG. 2 is connected with an upper end of the multi-cyclone unit 11 and guides the air discharged from the first cyclone chamber S1 into the secondary cyclone chambers S2. The cover unit 13 includes a first cover 70, a second cover 80, and a gasket 90, best seen in FIG. 2.

The first cover 70 covers an upper portion of the first cyclone chamber body 20 and is a generally circular plate having an inlet duct 71 and a discharge duct 73. The inlet duct 71, shown in cross section in FIG. 3, is an air guide passage that extends from a center of the first cover 70 toward the secondary cyclone chambers S2 in a generally radial direction. When the air discharged from the first cyclone chamber S1 is guided to the secondary cyclone chambers S2 by the inlet duct 71, a centrifugal force is generated.

The discharge duct 73 is a circular pipe that is inserted in the secondary cyclone chambers S2 to a predetermined depth. The air from which dirt is separated in the secondary cyclone chamber S2 is discharged through the discharge duct 73 (see FIG. 3).

The second cover 80 covers an upper portion of the first cover 70, for collecting the air discharged from the discharge duct 73 and guiding the air into an upper duct 75. The air discharged from the discharge duct 73 collides with the second cover 80 and is then guided through the upper duct 75.

An air stagnating/decelerating chamber S3, best seen in FIG. 3, is formed between the first cover 70 and the second cover 80. Because the air stagnating chamber S3 is larger than the discharge duct 73, the dirt is separated from the air discharged from the discharge duct 73. More specifically, the air loses velocity, (i.e., decelerates by an amount sufficient to transport the dirt when flowing into the relatively broader air stagnating chamber S3) so that the dirt is separated from the air. Accordingly, it is possible to separate minute dirt which was not separated in the secondary cyclone chambers S2. The separated dirt collects in the air stagnating chamber S3 and is discarded by detaching the second cover 80.

A gasket 90 is preferably used between the first cover 70 and the secondary cyclone chamber bodies 30 to prevent the air from escaping between the first cover 70 and the secondary cyclone chamber bodies 30. As can be seen, the gasket 90 has a plurality of openings 90*a* corresponding to the plurality of secondary cyclone chambers S2. The openings 90*a* each have non-circular shapes to increase the gravity of the air discharged from the inlet duct 71.

The air discharge duct 14 is disposed in the center of the cover unit 13 and the dirt collecting unit 12 to allow the air that has been discharged from the secondary cyclone chambers S2 to be discharged downwardly through the multi-cyclone unit 11 and the dirt collecting unit 12.

The air discharge duct 14 includes the upper duct 75, which may integrally formed with the multi-cyclone unit 11, and the lower duct 41, which may be integrally formed with the dirt collecting unit 12. The upper duct 75 is disposed in a center of the first cover 70 and is a circular pipe that protrudes downward from the first cover 70. The air escaping from the discharge duct 73 of the first cover 70 collides with the second cover 80 and moves down to the multi-cyclone unit 11 through the upper duct 75.

A grill 100, disposed around the upper duct 75, includes perforations 100*a* and a skirt 100*b* to prevent the dirt collected in the main dust receptacle 40 from flowing back to the secondary cyclone chambers S2. A connection passage 101

(see FIG. 3) is disposed between the grill 100 and the upper duct 75 to allow the air to move from the first cyclone chamber S1 to the secondary cyclone chambers S2.

The lower duct 41 is disposed in a center of the main dust receptacle 40 and is a circular pipe that protrudes, upward from the main dust receptacle 40. The lower duct 41 is connected to the upper duct 75. The lower duct 41 guides the air from the upper duct 75 down to the multi-cyclone unit 11 and the collecting unit 12 as an arrow F of FIGS. 3 and 4B. A packing member 130 may be disposed around a connection portion between the upper duct 75 and the lower duct 41 to prevent the air from escaping.

As a result, because the air discharge duct 14 penetrates through the multi-cyclone dust separating apparatus 10 and the suction force source (not shown) is connected to the air discharge duct 14, the multi-cyclone dust separating apparatus 10 has the shortest path for transmitting the suction force to the first cyclone chamber S1 and to the secondary cyclone chambers S2. Since the suction force source (not shown) is directly connected to the air discharge duct 14, an additional duct is not required to connect them.

Hereinafter, operation of the multi-cyclone dust separating apparatus 10 according to another non-limiting embodiment of the present invention will now be described. The arrow X indicates flows of air and the arrow X indicates suspended dirt particles.

Referring to FIG. 3, a suction force generated by the suction force source (not shown) disposed under the filter 110 is transmitted through the shortest pathway (i.e., from the filter 110, the lower duct 41, and the upper duct 75) to the air stagnating chamber S3, the secondary cyclone chambers S2, and the first cyclone chamber S1. The dust laden air is drawn in the first cyclone chamber S1 through the air suction port 21*a* by the transmitted suction force.

Dirt is first separated from the air in the first cyclone chamber S1 and is collected in the main dust receptacle 40 through the cylinder part 51 (see FIG. 2) of the sub-dust receptacle 50. Filtered air passes through the perforations 100*a* (see FIG. 2) of the grill 100 and the connection passage 101 and is guided to the secondary cyclone chambers S2 through the inlet duct 71 of the first cover 70 with the suction force.

The dirt is secondarily separated from the air in the secondary cyclone chambers S2 and collected in the sub-dust receptacle 50. More specifically, when the air moves down to the secondary cyclone chambers S2 and moves through the secondary cyclone chambers S2, more dirt is separated from the air and is piled on the bottom of the pocket portion 53. The filtered air is discharged through the discharge duct 73.

The secondarily filtered air is thirdly separated in the air stagnating chamber S3 formed between the first cover 70 and the second cover 80 and piled in the air stagnating chamber S3. The air collides with the second cover 80 and is guided to the filter mounting chamber S4 through the upper duct 75 and the lower duct 41 formed in the center of the first cover 70.

The thirdly filtered air is fourthly separated by the filter 110 of the filter mounting chamber S4. The air is discharged from the multi-cyclone dust separating apparatus 10. Through the first to fourth separating procedures, minute dirt can be separated.

Since the dirt is separated from the air by passing through the first and the secondary cyclone chambers S1 and S2, the air stagnating chamber S3, and the filter 110 of the filter mounting chamber S4, the minute dirt can be separated. Accordingly, the dust collection efficiency can be improved.

Since the air discharge duct 14 is disposed through the center of the multi-cyclone dust separating apparatus 10, the way to transmit the suction force is shortest and thus, a suction force loss can be minimized. Also, since the suction force source is directly connected to the air discharge duct 14, an additional duct is not required to connect them. Accordingly, the structure of the multi-cyclone dust separating apparatus 10 becomes simplified and manufacturing costs can be reduced.

Since the main dust receptacle 40 is detachable from the sub-dust receptacle 50, the main dust receptacle 40 and the sub-dust receptacle 50 are selectively emptied according to their respective amounts of collected dirt. Also, a user easily detaches the main dust receptacle 40 from the sub-dust receptacle 50 when one of them needs to be cleaned or repaired. Since the sub-dust receptacle 40 is nested in the main dust receptacle 50, a volume of the dirt collecting unit 12 can be reduced. As a result, the size of the multi-cyclone dust separating apparatus 10 can be reduced.

Fine and/or particulate dusts, which can be separated from the air when the air is passed through the lower duct and drawn toward the vacuum source, are collected by the filter inserted into the filter mounting chamber. Accordingly, inflow of fine and/or particulate dusts into the vacuum source is prevented.

As a non-limiting example, the filter mounting cover may be connected to the filter mounting chamber by rotating. As a result, the filter may be easily connected or disconnected from the filter mounting chamber. Accordingly, it is easy to clean and repair the filter.

The foregoing embodiments and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A multi-cyclone dust separating apparatus, comprising:

a multi-cyclone unit including, a first cyclone chamber body having a first cyclone chamber and at least one protection chamber formed around at least a portion of an outer circumference of the first cyclone chamber, and at least one secondary cyclone chamber body disposed in the at least one protection chamber, the at least one secondary cyclone chamber body having at least one secondary cyclone chamber;

a cover unit adapted to connect to an upper end of the multi-cyclone unit and configured to guide air discharged from the first cyclone chamber to the at least one secondary cyclone chamber;

a dirt collecting unit adapted to connect to a lower end of the multi-cyclone unit and configured to collect dirt separated from the air in the first and the secondary cyclone chambers; and an air discharge duct disposed proximate to a center of the cover unit and the dirt collecting unit and configured to downwardly discharge air that has passed through the at least one secondary cyclone chamber through the multi-cyclone unit and the dirt collecting unit.

2. The multi-cyclone dust separating apparatus as claimed in claim 1, wherein:

the at least one protection chamber includes a plurality of the protection chambers formed around at least a portion of the outer circumference of the first cyclone chamber, and at least one additional protection chamber is formed around a second portion of the outer circumference of the first cyclone chamber separated from the plurality of protection chambers.

3. The multi-cyclone dust separating apparatus as claimed in claim 2, wherein the cover unit includes:

a first cover having an inlet duct configured to guide the air discharged from the first cyclone chamber to the at least one secondary cyclone chamber;

a gasket disposed between the first cover and the at least one secondary cyclone chamber body; and a second cover disposed on an upper portion of the first cover.

4. The multi-cyclone dust separating apparatus as claimed in claim 2, wherein each of the plurality of protection chambers includes a plurality of secondary cyclone chamber bodies formed integrally with one another.

5. The multi-cyclone dust separating apparatus as claimed in claim 1, wherein the air discharge duct includes an upper duct penetrating through the multi-cyclone unit and a lower duct penetrating through the dirt collecting unit.

6. The multi-cyclone dust separating apparatus as claimed in claim 5, wherein the upper duct is formed integrally with the cover unit and the lower duct is formed integrally with the dirt collecting unit.

7. The multi-cyclone dust separating apparatus as claimed in claim 6, wherein the dirt collecting unit includes:

a main dust receptacle configured to store dirt separated in the first cyclone chamber; and a sub-dust receptacle configured to store dirt separated in the at least one secondary cyclone chamber.

8. The multi-cyclone dust separating apparatus as claimed in claim 7, wherein the sub-dust receptacle is removably nested in the main dust receptacle.

9. The multi-cyclone dust separating apparatus as claimed in claim 8, wherein the dirt collecting unit further includes:

a filter insertable in a lower portion of the main receptacle; and a filter mounting cover configured to fix the filter.

10. The multi-cyclone dust separating apparatus as claimed in claim 9, wherein the main receptacle includes a filter mounting chamber connectable to the lower duct.

11. The multi-cyclone dust separating apparatus as claimed in claim 10, wherein the filter mounting cover includes:

a first circular portion adapted to receive the filter; and a second circular portion for supporting the first circular portion.

12. The multi-cyclone dust separating apparatus as claimed in claim 11, wherein the filter mounting cover is connectable to the filter mounting chamber by press fitting.

13. The multi-cyclone dust separating apparatus as claimed in claim 11, wherein the filter mounting cover is configured to rotate to fit the filter mounting chamber.

14. A multi-cyclone dust separating apparatus comprising:

a multi-cyclone unit including, a first cyclone chamber having a wall with a circumference;

a plurality of secondary cyclone chambers positioned around the circumference of the first cyclone chamber;

an air stagnating chamber for connecting the first cyclone chamber and the secondary cyclone chambers; and a dirt collecting unit adapted to connect to a lower end of the multi-cyclone unit and having a filter mounting chamber formed on a lower portion thereof connected to the air stagnating chamber and receiving a filter, wherein dirt is separated from the air when the air passes through the first and the secondary cyclone chambers, the air stagnating chamber, and the filter.

15. The multi-cyclone dust separating apparatus as claimed in claim 14, wherein the air stagnating chamber and the filter mounting chamber are connected to each other by an air discharge duct disposed in a center of the multi-cyclone dust separating apparatus.

* * * * *